US005765439A

United States Patent [19]

Araki

[11] Patent Number: 5,765,439

[45] Date of Patent: Jun. 16, 1998

[54] STARTER WITH IMPROVED PINION RESTRICTION STRUCTURE

[75] Inventor: Takeshi Araki, Nishikasugai-gun, Japan

[73] Assignee: Nippondenso Co., Ltd., Japan

[21] Appl. No.: 639,505

[22] Filed: Apr. 29, 1996

[30] Foreign Application Priority Data

Apr. 28, 1995 [JP] Japan ..... 7-105706
Apr. 17, 1996 [JP] Japan ..... 8-095575

[51] Int. Cl.[6] ..... F02N 15/06

[52] U.S. Cl. ..... 74/7 R; 74/7 A; 74/7 E; 290/38 R; 290/48

[58] Field of Search ..... 74/7 A, 7 E, 7 R; 290/38 R, 48

[56] References Cited

U.S. PATENT DOCUMENTS

| | | | |
|---|---|---|---|
| 1,424,766 | 8/1922 | McGrath | 290/48 |
| 2,318,232 | 5/1943 | Kearney | 74/7 R |
| 2,327,960 | 8/1943 | Christian | 74/7 R |
| 3,868,858 | 3/1975 | Reichardt et al. | 74/7 R |
| 5,443,553 | 8/1995 | Shiga et al. | 74/7 R |

FOREIGN PATENT DOCUMENTS

| | | | |
|---|---|---|---|
| 739935 | 7/1932 | France | 290/38 R |
| 2552823 | 4/1985 | France . | |
| 50-18915 | 2/1975 | Japan . | |
| 1371105 | 10/1974 | United Kingdom . | |

*Primary Examiner*—Charles A. Marmor
*Assistant Examiner*—Troy Grabow
*Attorney, Agent, or Firm*—Cushman Darby & Cushman Intellectual Property Group of Pillsbury Madison & Sutro, LLP

[57] ABSTRACT

A starter for an automotive vehicle is comprised of an output shaft rotationally driven by a DC motor, a pinion having on its inner circumference a helical spline engaged with a helical spline on the output shaft. A pinion restricting member has a long arm engageable with teeth formed on the outer circumference of the pinion. A drive housing abuts axially at the pinion restricting member, and a center case abuts axially against the pinion restricting member. The pinion restricting member is held assuredly and axially by the drive housing and the center case.

20 Claims, 4 Drawing Sheets

STARTER WITH IMPROVED PINION RESTRICTION STRUCTURE

BACKGROUND OF THE INVENTION

1. Field of the Invention

This invention relates to a starter for use in starting an engine and, more particularly, a starter for starting an engine by transmitting a rotation of a pinion to a ring gear of the engine.

2. Related Art

In a gazette of Japanese Patent Laid-Open No. Sho 50-18915, for example, starter for starting or cranking an engine is described in which rotation of a pinion engaged with an output shaft driven by a DC motor through a helical spline is restricted by a restricting member to cause the pinion to be engaged with the ring gear of the engine under the action of the helical spline.

The restricting member for the starter is a round bar slidably arranged in the guiding hole extending in a direction of the diameter of a housing. This round bar is formed with an opening perpendicular to the guiding hole and one leg of an angle lever is fitted to the opening. The angle lever is attached to a supporting part in the housing that it may be turned within a plane crossing at a right angle with an output shaft. The other leg of the angle lever faces a magnetic pole of an electro-magnet within the housing. When the electro-magnet is energized, the other leg of the angle lever is retracted. The angle lever is rotated around the supporting part of the housing, thereby one leg of the angle lever causes the round bar arranged within the guiding hole of the housing to abut against a stopper tooth formed on the threaded sleeve.

In addition, the threaded sleeve is connected to an overrunning clutch having a pinion gear. The round bar abuts against the stopper tooth of the threaded sleeve to cause the overrunning clutch to move toward the ring gear under an action of the helical spline on the output shaft and then the pinion gear is engaged with the ring gear.

However, assembly of the prior art starter in which the round bar, the angle lever, the overrunning clutch with the pinion gear arranged on the output shaft and the threaded sleeve or the like are assembled within the housing is difficult, particularly in that shows an inability of assembling and a quite poor the output shaft having the overrunning clutch with the pinion gear and the threaded sleeve and the like assembled there to is inserted from the motor side after the round bar is inserted into the guiding hole of the housing. Moreover, the angle lever is inserted from the axial direction of the housing and the angle lever is fixed and fastened with a screw since the output shaft must be inserted so that the overrunning clutch does not interfere with the round bar assembled to the housing and the angle lever fitted to the round bar.

In particular, assembly of the restricting members such as the round bar, the angle lever and the screw for fixing the angle lever within the housing is quite difficult to perform and there is a possibility that the manufacturing cost will be increased.

SUMMARY OF THE INVENTION

In view of the foregoing, it is an object of the present invention to provide a starter capable of reducing manufacturing cost by simplifying assembly of the restriction members.

According to the present invention, restricting members are arranged to be held between a first supporting frame and a second supporting frame along a crossing plane crossed with the output shaft while avoiding rotation restricting segments of the restriction members. The restriction members for restricting a movable cylinder member can be easily assembled under a mere stacking in sequence of the second supporting frame. The restriction members and the first supporting frame are assembled only from an axial side of the output shaft, i.e. only one direction of it, and thus the cost of manufacturing the starter can be reduced.

Preferably, the restricting member can be resiliently deformed, so that it can be rotated at least more than ½ pitch of a pinion gear as the pinion gear is rotated. Thus, even if both a striking load in a rotating direction of the movable cylinder member and an axial load are applied to the restricting member, the restricting member is flexed and a force applied to the two supporting frames is reduced.

It also sometimes occurs that when the pinion gear is engaged with the ring gear, a tooth surface of the pinion gear of the movable cylinder member is not aligned with a tooth surface of the ring gear. These end surfaces are abutted to each other and the pinion gear and the ring gear are not engaged to each other. However, at this time, since the restricting member is rotated together with the movable cylinder member having the pinion gear, the tooth surface of the pinion gear and the tooth surface of the ring gear can be aligned to each other, resulting in that the movable cylinder member can be moved and engaging states are completed.

Preferably, the restricting member is slidably supported between the first supporting frame and the second supporting frame in a direction transverse with in respect to the output shaft.

Preferably, a reaction force in a rotating direction applied to the restricting member can be forcibly received with a restricting part at the first supporting frame or a restricting part at the second supporting frame, so that a reaction force caused by a resilient deformation of the restricting member can be positively applied to the movable cylinder member and an engaging characteristic between the pinion gear and the ring gear can be improved.

Preferably, the second supporting frame has a bearing member for supporting the output shaft at a side of the movable cylinder member facing against the ring gear. A supporting part for supporting the rotation restricting part of the restricting member is stored at an outer circumference of the bearing member, whereby the first supporting frame for holding the supporting part of the restricting member can also be arranged within the space there and an axial length of the starter can be shortened.

Preferably, even when an outer diameter of the restricting member and an outer diameter of the movable cylinder member are the same and the restricting member can not be directly supported from its axial direction, the restricting member can be slidably supported between the first supporting frame and the second supporting frame in a direction transverse with respect to the output shaft.

More preferably, when the restricting member stops a rotation of the movable cylinder member with a strong force, the force applied to the restricting member in a rotating direction can be forcibly received at the inner walls of the first supporting frame and second supporting frame. Alternatively, the force applied to the restricting member in a rotating direction can be forcibly received at the inner wall part of the annular insertion plate, so that it is possible to improve the durability of the first and second supporting frames and the insertion plate.

BRIEF DESCRIPTION OF THE DRAWINGS

Other objects and features of the present invention will become more apparent from the following description when read with reference to the accompanying drawings, in which.

DESCRIPTION OF THE PRESENTLY PREFERRED EMBODIMENTS

Referring now to the accompanying drawings, embodiments of the present invention will be described with reference to its preferred embodiments.

Figure 1:
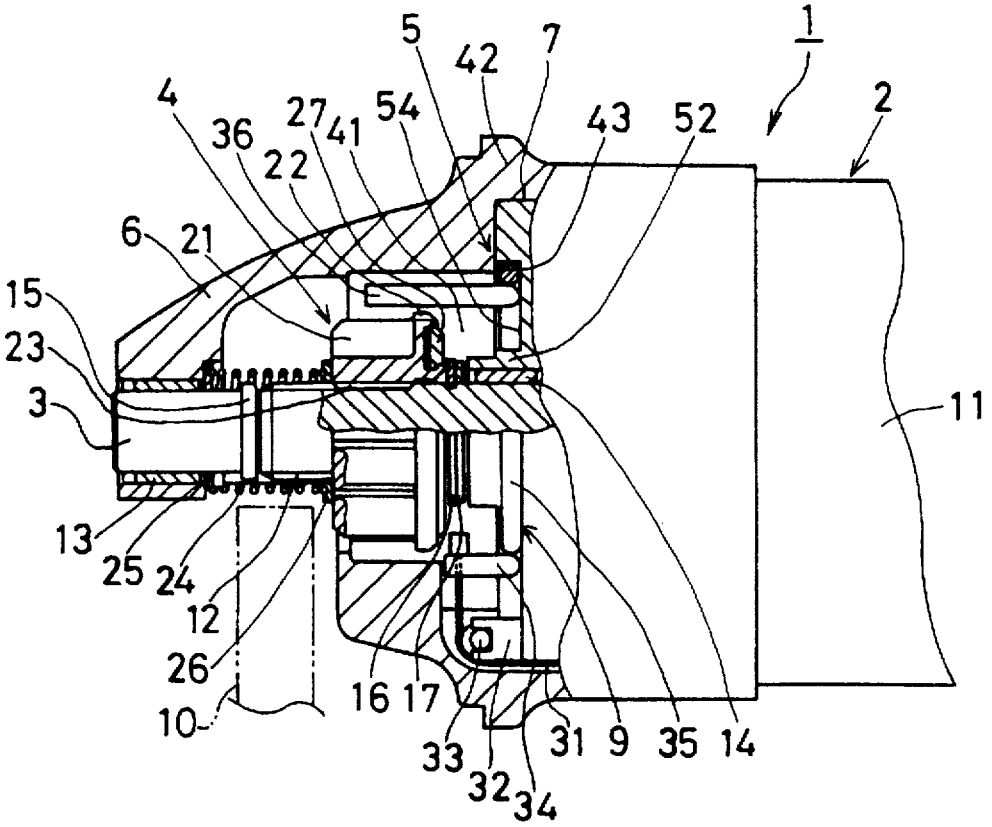
FIG. 1 is a partial sectional view showing a major part of a starter (a first embodiment)
Figure 2:
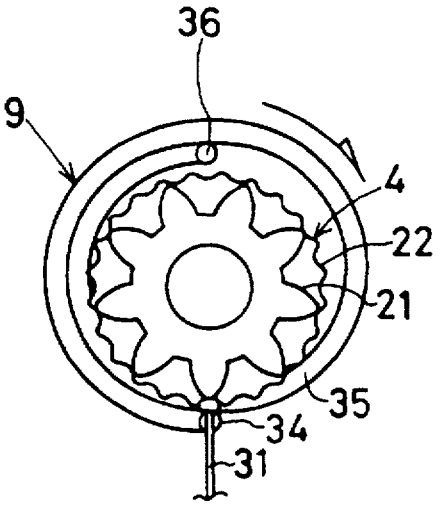
FIG. 2 is a front elevational view showing a major part of a pinion restricting device of a starter (a first embodiment)
Figure 3:
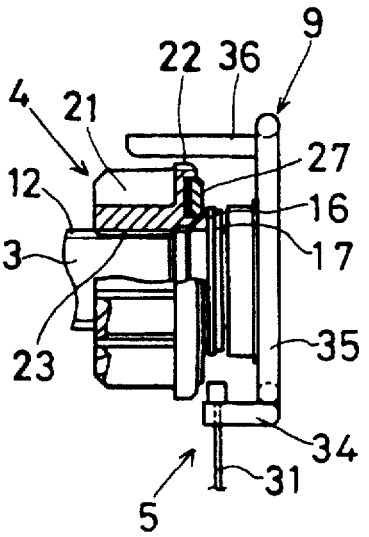
FIG. 3 is a side elevational view showing a major part of a pinion restricting device of a starter (a first embodiment)
Figure 4:
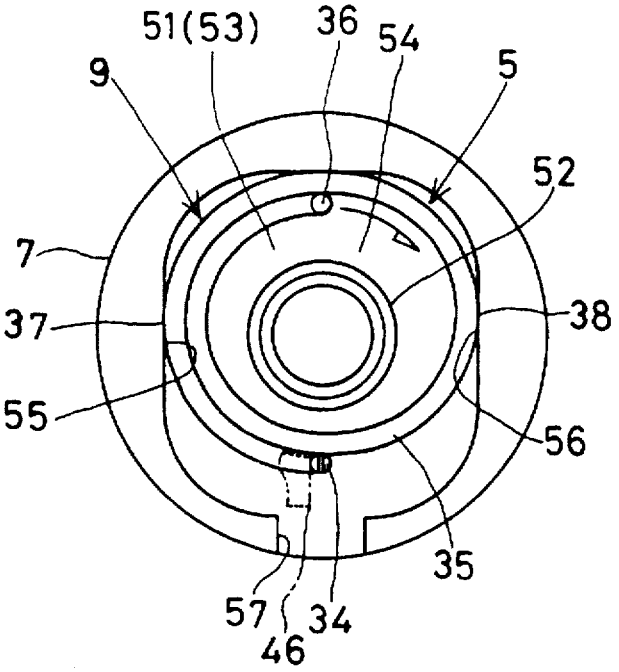
FIG. 4 is a front elevational view showing a supporting structure for a pinion restricting member.
Figure 5:
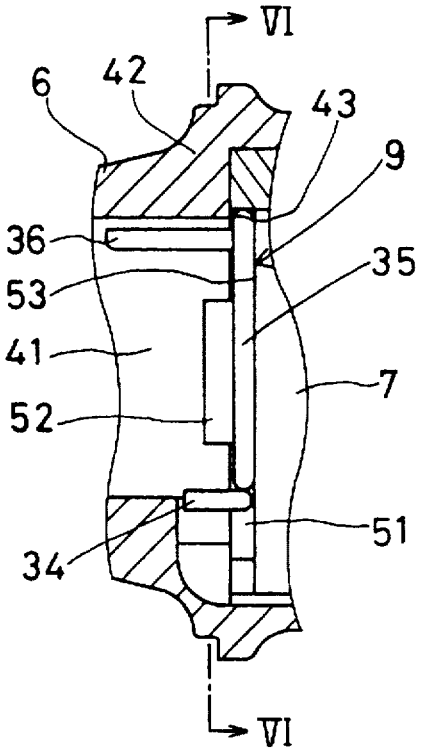
FIG. 5 is a sectional view showing a supporting structure for a pinion restricting member.
Figure 6:
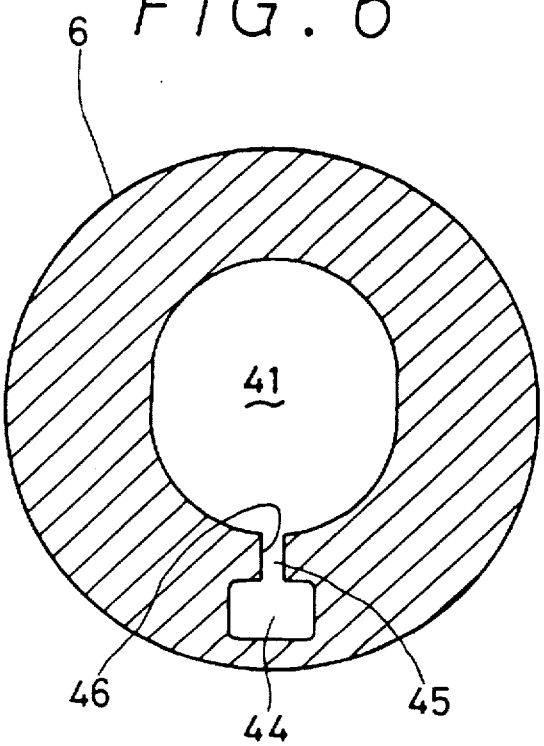
FIG. 6 is a sectional view taken along a line VI—VI of FIG. 5 (a first embodiment)
Figure 7:
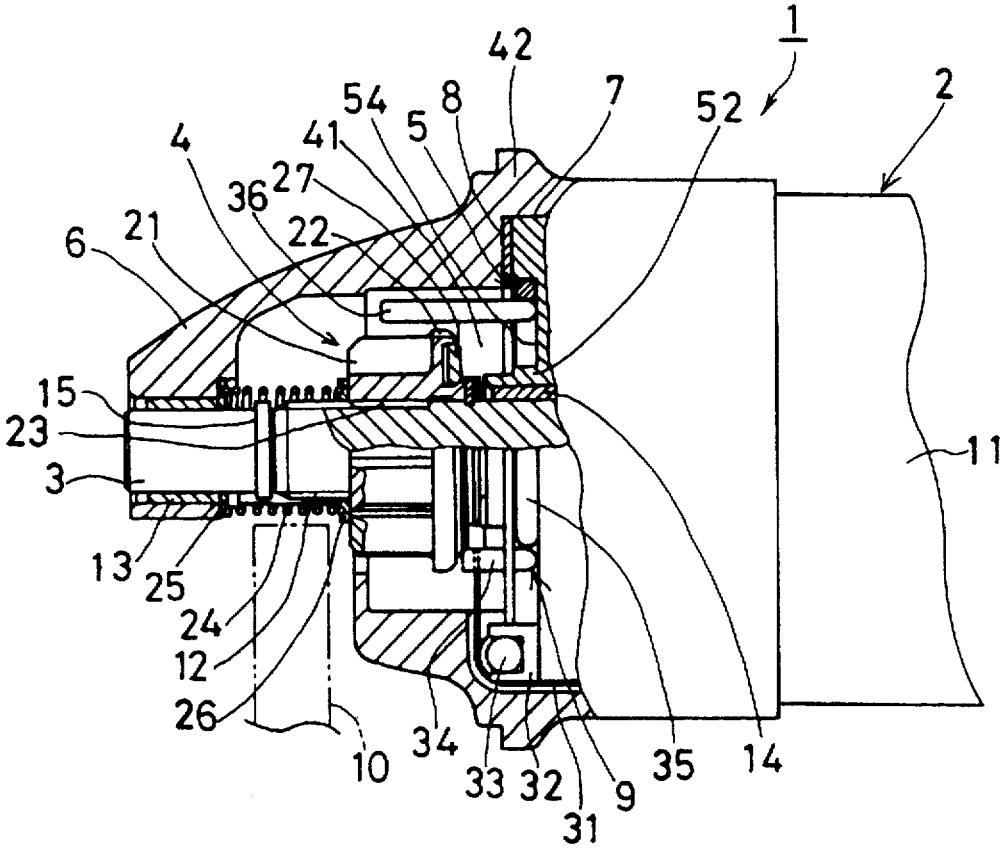
FIG. 7 is a partial sectional view showing a major part of a starter (a second embodiment)

FIGS. 1 to 6 illustrate a starter according to the first preferred embodiment of the present invention, wherein FIG. 1 is a view showing a major part of the starter, FIGS. 2 and 3 are views showing a major part of a pinion restricting device of the starter, and FIGS. 4 to 6 are views showing a supporting structure for the pinion restricting member.

The starter 1 is an engine starting device for use in starting or cranking an engine (not shown), including a DC motor (a starter motor) 2 with a battery (not shown) as its power supply; an output shaft 3 rotationally driven by the DC motor 2; a pinion 4 (a movable cylinder member of the present invention) rotatably attached to an outer circumference of the output shaft 3; a pinion restricting device 5 for restricting rotation of the pinion 4; a drive housing 6 for movably storing the pinion 4; a center case 7 (a second supporting frame of the present invention) arranged between the drive housing 6 and the DC motor 2; and a magnet switch (not shown) for turning on or off an exciting current to the DC motor 2.

The DC motor 2 is comprised of a rotating armature, a field coil for generating a magnetic field, and brushes for flowing an electrical current to the armature in the known manner. The field coil is directly wound around a pole core (not shown) fixed to the inner circumference of a yoke 11. The field coil may be of a permanent magnet.

Between the armature (not shown) of the DC motor 2 and the output shaft 3 is installed an overrunning clutch (not shown) acting as a power transmitting means. The overrunning clutch is used for preventing damage to the armature in its overrun against a rotation of the engine.

The output shaft 3 is connected to an armature shaft of the DC motor 2 through the overrunning clutch. An outer circumference at the central part of the output shaft 3 is formed with a helical spline 12. The extremity end of the output shaft 3 is rotatably supported at the drive housing 6 (a first supporting frame of the present invention) through a bearing 13 and the rear end of the output shaft 3 is rotatably supported at the center case 7 through a bearing 14.

At the outer circumference of the output shaft 3 of the extremity end from the helical spline 12 is fixed a ring-like stopper 15 acting as an engaging means for restricting the motion of the pinion 4 toward the axial extremity end of it. In addition, at the outer circumference of the output shaft 3 of the rear end from the helical spline 12 in the output shaft 3 is fixed a C-shaped stopper (a C-shaped clip) 16 acting as an engaging means for restricting motion of the output shaft 3 toward an axial end of the output shaft 3. Between the C-shaped clip 16 and the center case 7 is arranged a ring-plate shaped washer 17.

Referring to FIGS. 1 to 3 in particular, the pinion 4 will be described. This pinion 4 is comprised of a cylindrical metallic member. At an outer circumference of the pinion 4, a pinion gear 21 is integrally formed 22.

The pinion gear 21 is arranged for engagement with the ring gear 10, and comprised of a plurality (nine for example) of corrugated teeth equally spaced apart on the outer circumference of the pinion 4. The teeth 22 are also equally spaced apart on an outer circumference of the pinion 4 for engagement with the pinion restricting device 5.

In addition, at the inner circumference of the pinion 4 is formed with a pinion helical spline 23 engaged with the helical spline 12.

At the extremity end of the pinion 4, a return spring (a coil spring) 24 is provided, acting as a biasing means for biasing the pinion 4 in a direction to return to its initial position (the position shown in FIG. 1). The extremity end of the return spring 24 is supported by the ring-plate shaped washer 25 slidably contacted with the drive housing 6, and its rear end is supported at the ring-plate shaped washer 26 slidably contacted with the extremity end surface of the pinion 4. In addition, a ring-plated shaped washer 27 is installed at the rear end surface of the pinion 4.

Referring to FIGS. 1 to 5, the pinion restricting device 5 will be described. This pinion restricting device 5 is comprised of a strap-like member 31 displaced to be reciprocated under an action of the magnet switch and a pinion restricting member 9 (a restricting member of the present invention) for restricting the rotation of the pinion 4 or the like. The strap-like member 31 is slidably supported by a roller (shaft) 33 rotatably supported within a roller bearing 32, and is a drive transmitting means for moving the pinion restricting member 9 in a downward direction as viewed in FIG. 1 when the magnet switch is turned on.

The pinion restricting member 9 is comprised of a strong high carbon steel wire of which resilient deformation can be attained (for example, its wire diameter is $\phi$2 mm to $\phi$3 mm), the member is composed of a short arm 34 connected to the strap member 31, a spiral part 35 (the supporting part of the present invention) wound more inside the end part of the short arm 34 and a long arm 36 extended axially in parallel with the output shaft 3 from the end part of the spiral part 35. The short arm 34 is extended from the lower end of the spiral part 35 in parallel with an axial direction of the output shaft 3.

The spiral part 35 has two sliding portions 37, 38 slidable in a vertical direction in respect to an axial direction of the output shaft 3 within the center case 7, its minimum inner diameter part is larger than an outer diameter of the pinion 4. The long arm part 36 is a rotation restricting part (an engaging part) for stopping a motion of the pinion 4 in its rotating direction when it is engaged with the upper-located one of the teeth 22 formed on the outer circumference of the pinion 4.

One end of the coil spring (not shown) is engaged with the long arm 36 of the pinion restricting member 9 so as to cause the pinion restricting member 9 to be biased away from the outer circumference of the pinion 4 in its direction of diameter. In addition, the other end of the coil spring is engaged with a projection (not shown) of the center case 7.

Then, a supporting structure for the pinion restricting member 9 will be described with reference to FIGS. 1, 4 and 6. The drive housing 6 is the first supporting frame of the present invention, and this is integrally formed by an aluminum die-cast, for example, and further this is the first supporting means for supporting the pinion restricting member 9 in a direction parallel with an axial direction of the output shaft 3 (hereinafter referred to as an axial direction).

The drive housing 6 is arranged at the extremity end of the output shaft 3, not at the pinion restricting member 9, i.e. at a side of the ring gear 10. Within the drive housing 6 a gear chamber 41 is formed for movably storing the pinion 4 in an axial direction. This gear chamber 41 is an opening of the present invention, which is larger than an outer diameter of each of teeth 22 (the maximum outer diameter) and smaller than an outer diameter of the spiral part 35 of the pinion restricting member 9.

In addition, the drive housing 6 is made such that an end surface of the fitting part 42 in which the center case 7 is fitted while it is being abutted axially against the center case 7 becomes an abutting part (a first abutting part) 43 axially abutted against the maximum outer diameter part of the spiral part 35 of the pinion restricting member 9. This abutting part 43 may act as the first holding part (the first supporting part) for holding the spiral part 35 for the pinion restricting member 9 between it and the center case 7. Then, at the lower part of the center case 7 of the drive housing 6, i.e. as shown in FIG. 6, at the lower part of the gear chamber 41 is formed a rectangular-shaped insertion hole 44 through which the strap member 31 of the pinion restricting device 5 is passed or inserted.

In addition, an insertion hole 45 is formed between the gear chamber 41 and the insertion hole 44 for use in communicating with the gear chamber 41 and the insertion hole 44 and through which the strap-like member 31 of the pinion restricting device 5 is passed. Within the insertion hole 45, the short arm 34 of the pinion restricting member 9 is slidably supported with a vertical direction in respect to an axial direction of the output shaft 3. In addition, at the lower part of the drive housing 6 (the inner wall surface of the insertion hole 45) a supporting wall 46 is formed for receiving a load of the short arm 34 of the pinion restricting member 9 in its rotating direction. This supporting wall 46 is a rotation restricting part for use in restricting rotation of the short arm 34 of the pinion restricting member 9.

The pinion restricting member 9 is held between the drive housing 6 and the center case 7 while avoiding the long arm 36 of the pinion restricting member 9 along a transverse plane that crosses the output shaft 3 (i.e. a crossing plane in which the pinion restricting member 9 is slid in a vertical direction in respect to an axial direction of the output shaft 3), and then the pinion restricting member 9 is slidably supported between the drive housing 6 and the center case 7 in a crossing direction along the crossing plane (i.e. a vertical direction with respect to the axial direction of the output shaft 3).

The long arm 36 of the pinion restricting member 9 can be rotated at least more than ½ pitch of the pinion gear 21 as the pinion 4 is rotated.

The center case 7 is integrally formed by an aluminum die-cast, for example, and this is the second supporting means for holding the pinion restricting member 9 between it and the drive housing 6 and supporting it from its axial direction. The center case 7 is arranged at the rear end of the output shaft 3 from the pinion restricting member 9, i.e. arranged at the side of the DC motor 2. A storing chamber 51 is formed within the center case 7 for slidably storing the pinion restricting member 9 in a vertical direction in respect to an axial direction of the output shaft 3.

This storing chamber 51 has its inner diameter larger than an outer diameter of the teeth 22 and an outer diameter of the pinion restricting member 9. Then, a cylindrical supporting wall 52 is formed at the central part of the storing chamber 51 for rotatably supporting the rear end of the output shaft 3 through the bearing 14. In addition, the bottom wall surface of the storing chamber 51 becomes an abutting part (a second abutting part) 53 abutted axially against the spiral part 35 of the pinion restricting member 9.

Then, the wall surface of the storing chamber 51 becomes the abutting part 54, and this abutting part 54 may act as a second holding part (a second supporting part) for holding the spiral part 35 of the pinion restricting member 9 between it and the abutting part 43 of the drive housing 6.

At the inner wall surface of the storing chamber 51 are arranged two sliding segments 55, 56 where two sliding segments 37, 38 of the spiral part 35 of the pinion restricting member 9 are slid in a vertical direction in respect to an axial direction of the output shaft 3. These sliding segments 55, 56 are inner walls of the present invention and are flat surfaces (two surfaces) generally in parallel with an axial direction of the output shaft 3. These sliding segments 55, 56 are also rotation restricting segments for use in restricting rotation of the spiral part 35 of the pinion restricting member 9. A recess part 57 is formed for avoiding an interference of the strap member 31 with the roller bearing 32.

The center case 7 has the bearing 14 for pivotally supporting the output shaft 3 at the counter-ring gear side of the pinion 4, and the center of the spiral part 35 is stored at an outer periphery of the bearing 14.

Next, assembly of the peripheral parts of the pinion 4 and the pinion restricting member 9 of the preferred embodiment will be described briefly in reference to FIGS. 1 to 6.

The pinion restricting member 9 is stored in the storing chamber 51 of the center case 7 as shown in FIG. 4 while the output shaft 3 is being inserted into the inner circumference of the supporting wall 52 of the center case 7. Then, after the pinion 4 is fitted onto the helical spline 12 of the output shaft 3, the stopper 15 is fitted to the outer peripheral circumference of the output shaft 3.

Then, the drive housing 6 is assembled with the center case 7. That is, the pinion restricting member 9 is forcibly supported from its axial direction by the abutting segments 43, 54 by fitting the fitting part 42 of the drive housing 6 with the center case 7. At this time, the pinion restricting member 9 is slidably held only in a vertical direction in respect to the axial direction of the output shaft 3 for the sliding segments 55, 56 of the storing chamber 51 of the center case 7.

Bearings 13, 14, C-shaped clip 16, washer 17, return spring 24, washers 25 to 27 and strap-like member 31 or the like acting as the peripheral parts of the pinion 4 and the pinion restricting member 9 or the like are properly arranged during the aforesaid-assembling operation. In addition, the peripheral parts of the pinion 4 and the pinion restricting member 9 may be assembled in accordance with the assembling order other than the aforesaid order.

Operation of the pinion restricting device 5 of the starter 1 of the preferred embodiment will be described briefly in reference to FIGS. 1 to 6.

When the engine is to be started, a vehicle driver turns on an ignition switch (not shown) to a START position, the magnet switch is operated to cause the strap-like member 31 to move toward the magnet switch (toward right and downward in FIG. 1), thereby the pinion restricting member 9 is moved downwardly as viewed in FIGS. 1 to 3, the long arm 36 of the pinion restricting member 9 is engaged with the teeth 22 formed on the upper side of the outer peripheral part of the rear end of the pinion 4 as viewed in the figure.

At the same time, a movable contact (not shown) of the magnet switch contacts a fixed contact (not shown), an electrical current is supplied from the power supply (battery) to the field coil or the armature coil of the DC motor 2 (only the armature coil in the case that the field side is constructed by permanent magnets) and then the armature shaft of the DC motor 2 is rotated.

Upon rotation of the armature shaft, the output shaft 3 is rotated in a direction indicated by an arrow in FIG. 2 after receiving its rotation through a power transmitting means such as an overrunning clutch or the like. At this time, the pinion 4 receives a rotating force from the output shaft 3 through the helical spline 23, although its rotation is restricted by the pinion restricting member 9 with the long arm 36 engaging with the teeth 22. Thus, the pinion 4 moves (advances) to the axial extremity end side on the output shaft 3, i.e. toward the ring gear 10 of the engine by overcoming a resilient force of the return spring 24.

In this case, the pinion restricting member 9 receives a rotating force (several hundred Newtons) by the teeth 22 of the pinion 4 in a direction indicated by an arrow in FIG. 4. At this time, as shown in FIG. 4, the pinion restricting member 9 receives its rotating force at the sliding part 56 of the storing chamber 51 of the center case 7 through the sliding part 38 of the spiral part 35, receives it at the supporting wall 46 of the drive housing 6 through the short arm 34, thereby the pinion restricting member is not rotated so as to prohibit positively a motion of the pinion 4 in the rotating direction.

In addition, the pinion restricting member 9 receives an axial force (several hundred Newtons) directed toward the extremity end of the output shaft 3 under an advancing motion of the pinion 4 toward the ring gear 10. In other words, although the long arm 36 is pulled toward the ring gear 10, the pinion restricting member 9 is forcibly held axially between the abutting part 43 of the drive housing 6 and the abutting part 54 of the center case 7, resulting in that the pinion restricting member 9 does not move toward the ring gear 10.

Then, as the pinion gear 21 formed around the outer circumference of the extremity end of the pinion 4 is abutted against the ring gear 10 so as to prevent the pinion 4 from being advanced, the spiral part 35 of the pinion restricting member 9 and the long arm 36 are flexed under an application of a further rotational force of the output shaft 3 and then the long arm 36 is slightly moved in a rotating direction of the output shaft 3. With such an arrangement as above, the pinion 4 is slightly rotated to cause the pinion gear 21 to be engaged with the ring gear 10, the rotating power (output) of the DC motor 2 is transmitted to the ring gear 10 and the engine is rotated.

At this time, the pinion restricting member 9 prohibits the pinion 4 from being retracted as follows. When the pinion gear 21 is completely engaged with the ring gear 10, the long arm 36 of the pinion restricting member 9 is disengaged from the teeth of the pinion 4 and dropped downward at the rear side of the washer 27.

After this operation, the magnet switch is turned off as the engine starts to operate and the strap-like member 31 is not pulled to the right and downward any more, the pinion rotation restricting member 9 returns to its initial position by a coil spring (not shown) and the pinion 4 is returned to a stand-still state.

[Advantages]

As described above, the starter 1 of this first embodiment is constructed such that the pinion restricting member 9 is held between the drive housing 6 and the center case 7 along the transverse plane crossing with the output shaft 3 except the long arm 36 of the pinion restricting member 9, the pinion restricting member 9 for restricting the pinion 4 can be easily assembled only through a mere stacking up the center case 7, the pinion restricting member 9 and the drive housing 6 in this order, resulting in that a manufacturing cost of the starter 1 can be reduced.

More particularly, when the pinion restrict ing member 9 is assembled between the abutting segments 43, 54 of the drive housing 6 and the center case 7, it is stored in a state shown in FIG. 4 in a storing chamber 51 of the center case 7 having the output shaft 3 inserted therein, the pinion 4 is assembled on the output shaft 3, thereafter the drive housing 6 and the center case 7 are fitted to each other to enable the pinion restricting member 9 to be easily assembled between the abutting parts 43, 54. Due to this construction, its assembling work is improved and its productivity is superior, resulting in that the manufacturing cost of the starter is reduced and a product cost of the starter 1 can be reduced.

Further, the pinion restricting member 9 is held strongly in an axial direction by the drive housing 6 and the center case 7, thereby it is not necessary to arrange a separate supporting member for supporting the pinion restricting member 9. Thus, the number of component parts can be reduced, so that the product cost can be further reduced. Accordingly, it is possible to provide the starter 1 for installation on a vehicle is low cost.

In addition, the pinion restricting member 9 is forcibly held in an axial direction by the drive housing 6 and the center case 7. Accordingly, even if a high load in a rotating direction and an axial load are applied to the pinion restricting member 9 in the case that the pinion restricting member 9 stops the rotation of the pinion 4 with a strong force, the drive housing 6 for supporting the pinion restricting member 9 or the center case 7 is not damaged and a durability of the starter 1 can be made long.

In addition, the pinion restricting member 9 can be resiliently deformed and it can be rotated at least by ½ pitch or more of the pinion gear 21 as the pinion gear 21 is rotated, so that even if the impact load in a rotating direction of the pinion 4 and axial load are applied to the pinion restricting member 9, the pinion restricting member 9 is flexed to reduce a force applied to the drive housing 6 and the center case 7.

Sometimes a tooth surface of the pinion gear 21 of the pinion 4 and a tooth surface of the ring gear 10 do not coincide with each other and their end surfaces abutt each other and are not engaged when the pinion gear 21 is engaged with the ring gear 10, although at this time, the pinion restricting member 9 is rotated together with the pinion 4 having the pinion gear 21, so that it is possible to align the tooth surfaces of the pinion gear 21 and the tooth surface of the ring gear 10 with each other and then the moving cylindrical member can be moved and their engagement can be completed.

In addition, the pinion restricting member 9 is made of high carbon steel wire of resilient material to have a proper rigidity. Even if an impact force in a rotating direction and an axial force are given to the pinion restricting member 9, the spiral part 35 and the long arm 36 of the pinion restricting member 9 are flexed to interfere with a force applied to the abutting parts 43, 54 and the sliding segments 55, 56 of the drive housing 6 or the center case 7. It is thus possible to prevent the drive housing 6 or the center case 7 from being damaged, resulting in that a durable life of the starter 1 can be made even longer.

In addition, the pinion restricting member 9 can be slidably supported in a crossing direction in respect to the output shaft 3 between the drive housing 6 and the center case 7.

In addition, since a reaction force in a rotating direction applied to the pinion restricting member 9 can be forcibly received at the supporting wall 46 of the drive housing 6 or the oscillating parts 55, 56 of the center case 7, a reaction force caused by a resilient deformation of the pinion restricting member 9 can be positively applied to the pinion 4 and then an engaging characteristic between the pinion gear 21 and the ring gear 10 can be improved.

In addition, since the center case 7 has the bearing 14 pivotally supporting the output shaft 3 at the counter-ring gear side of the pinion 4 and the spiral part 35 of the pinion restricting member 9 is stored at the outer circumference of the bearing 14, it is possible to arrange the drive housing 6 for holding the spiral part 35 of the pinion restricting member 9 at its space and so an axial length of the starter 1 can be shortened.

According to the first embodiment, the storing chamber is provided in the center case. The same advantages can be provided, however, even in the case that a storing chamber is provided in the drive housing 6.

FIGS. 7 to 12 illustrate the second preferred embodiment of the present invention, wherein the same or like reference numerals designate the same or like parts described in the first embodiment. The following description is directed to the major differences of the second embodiment from the first embodiment.

The pinion restricting member 9 of this preferred embodiment is of a type in which the outer diameter of the spiral part 35 is no different than an outer diameter of teeth 22 of the pinion 4, and it can not be directly supported in an axial direction by the drive housing 6 as disclosed in the first embodiment. Due to this construction, the pinion restricting member 9 is held in an axial direction between the drive housing 6 and the center case 7 through a substantial annular ring plate spacer 8.

Figure 12:
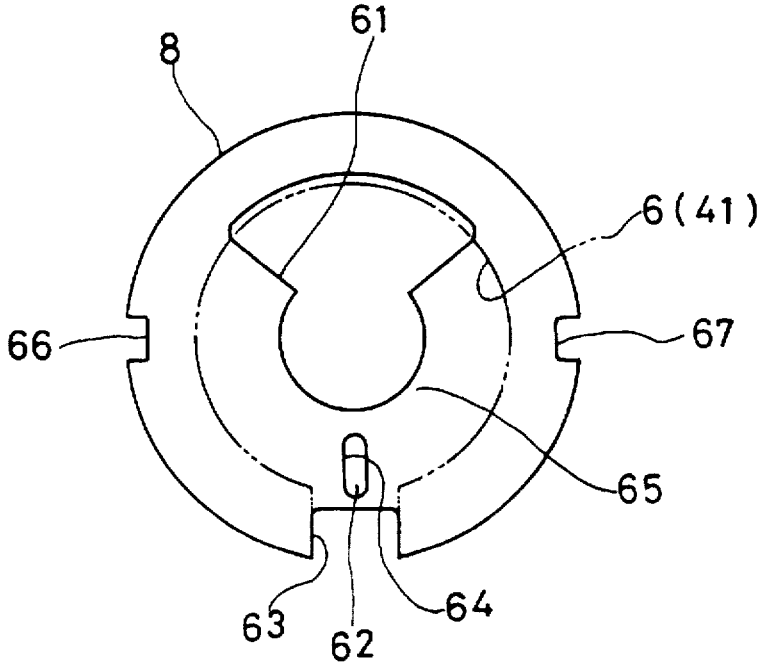
FIG. 12 is a front elevational view showing a spacer (a second embodiment).

The spacer 8 is an insertion plate of the present invention which is comprised of a steel plate, and as shown in FIG. 12, it has a substantially fan-shaped through-pass hole 61 through which the output shaft 3 passes and the long arm 36 of the pinion restricting member 9 can be moved in a vertical direction, an ellipse-shaped throughpass hole 62 through which the short arm 34 of the pinion restricting member 9 can be moved in a vertical direction, and a recess 63 for avoiding impact applied against the roller receiver 32 of the strap-like member 31. The wall surface of the through-pass hole 62 is formed with a supporting wall 64 for receiving a load of the short arm 34 of the pinion restricting member 9 in its rotating direction. This supporting wall 64 is also a rotation restricting part for use in restricting a rotation of the short arm 34 of the pinion restricting member 9.

In addition, a part of the spacer 8 near the center of the motor side surface becomes a substantial arcuate abutting part (a first abutting part) 65 abutted axially at the largest outer diameter part of the spiral part 35 of the pinion restricting member 9. This abutting part 65 may act as the first holding part (the first supporting part) for holding the spiral part 35 of the pinion restricting member 9 between it and the center case 7. Then, both sides of the spacer 8 in its direction of diameter are formed with two key grooves 66, 67 fitted to two projections 58, 59 arranged at the ring gear side surface at the center case 7. In FIG. 12, a two-dotted line indicates an inner circumferential shape of the gear chamber 41 of the drive housing 6.

Operation of the pinion restricting device 5 of the starter 1 of this preferred embodiment will be described briefly with in reference to FIGS. 7 to 12.

Figure 8:
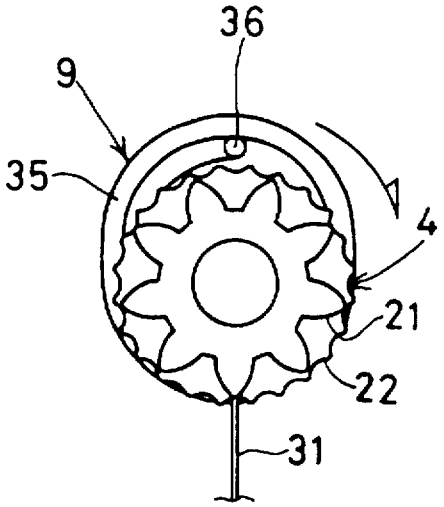
FIG. 8 is a front elevational view showing a major part of a pinion restricting device of a starter (a second embodiment)
Figure 9:
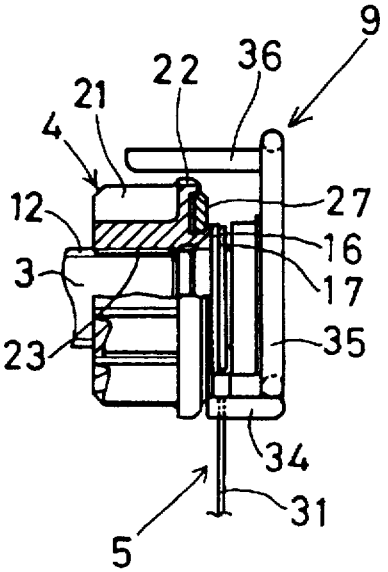
FIG. 9 is a side elevational view showing a major part of a pinion restricting device of a starter (a second embodiment)
Figure 10:
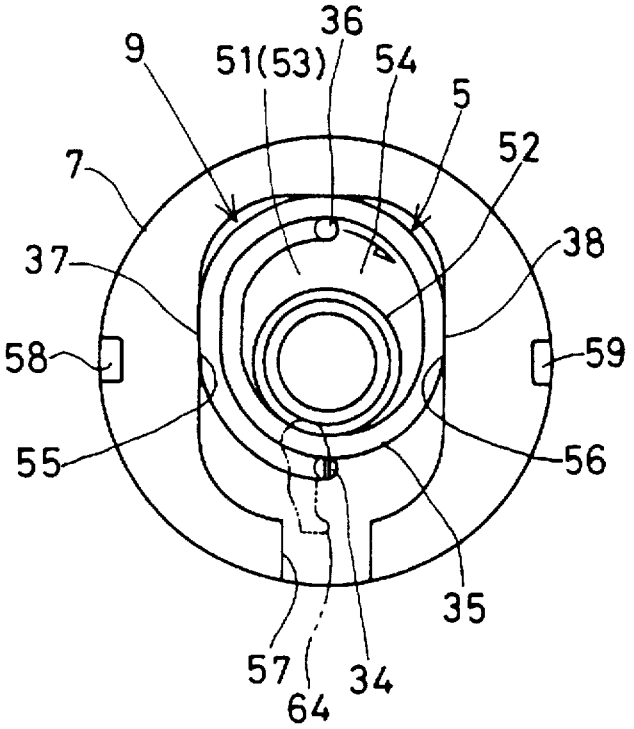
FIG. 10 is a front elevational view howing a supporting structure for a pinion restricting member (a second embodiment)
Figure 11:
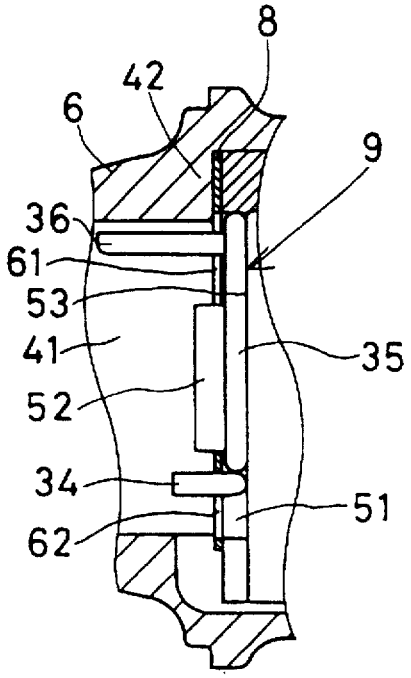
FIG. 11 is a sectional view showing a supporting structure for a pinion restricting member (a second embodiment)

As the DC motor 2 rotates, the pinion restricting member 9 receives a rotating force (several hundred Newtons) in a direction of arrow by the pinion 4 as shown in FIG. 8. The pinion restricting member 9 receives its rotating force at the sliding part 56 of the storing chamber 51 of the center case 7 through the sliding part 38 of the spiral part 35, receives it with the supporting wall 64 of the spacer 8 through the short arm 34, it is not rotated so as to make a positive prevention of motion of the pinion 4 in its rotating direction.

In addition, the pinion restricting member 9 receives an axial force (several hundred Newtons) directed toward the extremity end of the output shaft 3 when it is advanced toward the ring gear 10 of the pinion 4 under an action of rotation of the output shaft 3 and an action of the helical splines 12, 23. That is, although the long arm 36 is retracted toward the ring gear 10, the pinion restricting member 9 is being forcibly held in an axial direction between the abutting part 65 of the spacer 8 and the abutting part 54 of the center case 7, it may not be moved toward the ring gear 10.

As described above, in the starter 1 of the second preferred embodiment there is no difference in the outer diameters between the pinion restricting member 9 and the pinion 4 and it is advantageous in the case that it may not be directly supported by the drive housing 6 in an axial direction as in the first preferred embodiment. Further, the similar advantages as in the first embodiment can be provided.

Although in the preferred embodiments, the pinion gear 21 and the overrunning clutch are constructed as separate members, the pinion gear 21 and the overrunning clutch may be integrally formed with the pinion 4.

In addition, in place of the DC motor 2, an AC motor or other motors may also be used as driving means.

What is claimed is:

1. A starter comprising:

a starter motor;

an output shaft driven by said starter motor, said output shaft having a longitudinal axis;

a movable cylinder member having a pinion gear engageable with a ring gear of an engine and engaged with said output shaft through helical splines to be axially movable along said helical splines:

a restricting member having a rotation restricting part for abutting against the movable cylinder member and restricting rotation of said movable cylinder member, whereby said movable cylinder member moves toward said ring gear with a rotating force of said starter motor through said helical splines;

a first supporting frame having a larger opening than an outer diameter of said movable cylinder member; and a second supporting frame arranged at a starter motor side of said restricting member, wherein said restricting member is held between said first supporting frame and said second supporting frame, and said restricting member is positioned slidably between said first supporting frame and said second supporting frame in a direction transverse to said longitudinal axis, in a transverse plane crossing said output shaft, wherein said first supporting frame has an annular insertion plate for holding said restricting member with said second supporting frame, and said insertion plate has an opening which is larger than an outer diameter of said moveable cylinder member and smaller than an outer diameter of said restricting member.

2. A starter as set forth in claim 1, wherein:

said restricting member is resiliently deformable and adapted to be rotated by at least ½ pitch of said pinion gear as said pinion gear is rotated.

3. A starter as set forth in claim 1, wherein:

said opening of said first supporting frame is smaller than an outer diameter of said restricting member.

4. A starter as set forth in claim 1, wherein:

said second supporting frame has a bearing member for supporting said output shaft at one axial side of said movable cylinder member opposite to said ring gear, and a supporting part for supporting the rotation restricting part of said restricting member held by said first supporting frame and said second supporting frame is stored at an outer circumference of said bearing member.

5. A starter as set forth in claim 1, wherein:

said insertion plate has an inner wall abutted against an outer circumference of said restricting member at at least two surfaces in generally parallel with an axial direction of said output shaft.

6. A starter as set forth in claim claim 1, wherein:

said first supporting frame includes a housing for supporting said output shaft.

7. A starter as set forth in claim 2, wherein:

said opening of said first supporting frame is smaller than an outer diameter of said restricting member.

8. A starter as set forth in claim 2, wherein:

said second supporting frame has a bearing member for supporting said output shaft at a counter-ring gear side of said movable cylinder member, and a supporting part for supporting a rotation restricting part of said restricting member held by said first supporting frame and said second supporting frame is stored at an outer circumference of said bearing member.

9. A starter as set forth in claim 2, wherein:

said first supporting frame has an annular insertion plate for holding said restricting member with said second supporting frame, and said insertion plate has an opening which is larger than an outer diameter of said moving cylindrical member and smaller than an outer diameter of said restricting member.

10. A starter as set forth in claim 9, wherein:

said insertion plate has an inner wall abutted against an outer circumference of said restricting member at at least two surfaces generally in parallel with an axial direction of said output shaft.

11. A starter as set forth in claim 3, wherein:

said second supporting frame has a bearing member for supporting said output shaft at one axial side of said movable cylinder member opposite to said ring gear, and a supporting part for supporting the rotation restricting part of said restricting member held by said first supporting frame and said second supporting frame is stored at an outer circumference of said bearing member.

12. A starter as set forth in claim 3, wherein:

said first supporting frame has an annular insertion plate for holding said restricting member with said second supporting frame, and said insertion plate has an opening which is larger than an outer diameter of said moving cylinder member and smaller than an outer diameter of said restricting member.

13. A starter as set forth in claim 12, wherein:

said insertion plate has an inner wall abutted against an outer circumference of said restricting member at at least two surfaces generally in parallel with an axial direction of said output shaft.

14. A starter comprising:

a starter motor;

an output shaft driven by said starter motor, said output shaft having a longitudinal axis;

a movable cylinder member having a pinion gear engageable with a ring gear of an engine and engaged with said output shaft through helical splines to be axially movable along said helical splines;

a restricting member having a rotation restricting part for abutting against the movable cylinder member and restricting rotation of said movable cylinder member, whereby said movable cylinder member moves toward said ring gear with a rotating force of said starter motor through said helical splines;

a first supporting frame having a larger opening than an outer diameter of said movable cylinder member; and p1 a second supporting frame arranged at a side of said starter motor from said restricting member, wherein said restricting member is axially unmovably held between said first supporting frame and said second supporting frame, and said restricting member is positioned radially slidably between said first supporting frame and said second supporting frame in a direction transverse to said longitudinal axis, along a transverse plane crossing said output shaft, wherein said first supporting frame has an annular insertion plate for holding said restricting member with said second supporting frame, and said insertion plate has an opening which is larger than an outer diameter of said movable cylinder member and smaller than an outer diameter of said restricting member.

15. A starter as set forth in claim 14, wherein:

said restricting member is resiliently deformable and adapted to be rotated by at least one-half pitch of said pinion gear as said pinion gear is rotated.

16. A starter as set forth in claim 14, wherein:

said opening of said first supporting frame is smaller than an outer diameter of said restricting member thereby to restrict axial movement of said restricting member toward said movable cylinder member.

17. A starter as set forth in claim 14, wherein:

said second supporting frame has a bearing member for supporting said output shaft at one axial side of said movable cylinder member opposite to said ring gear, and a supporting part for supporting the rotation restricting part of said restricting member held by said first supporting frame and said second supporting frame is stored at an outer circumference of said bearing member.

18. A starter as set forth in claim 14, wherein:

said insertion plate has an inner wall abutted against an outer circumference of said restricting member at least two surfaces generally in parallel with an axial direction of said output shaft.

19. A starter as set forth in claim 14, wherein:

said first supporting frame includes a housing for supporting said output shaft.

20. A starter comprising:

a starter motor;

an output shaft driven by said starter motor;

a movable cylinder member having a pinion gear engageable with a ring gear of an engine and engaged with said output shaft through helical splines to be axially movable along said helical splines;

a restricting member having a spiral part and a rotation restricting part axially extending from the spiral part for abutting against the movable cylinder member and restricting a rotation of said movable cylinder member, wherein said movable cylinder member moves toward said ring gear with a rotating force of said starter motor through said helical splines;

a first supporting frame having a larger opening than an outer diameter of said movable cylindrical member; and a second supporting frame axially fitted with said starter motor around said restricting member, wherein one of said first supporting frame and said second supporting frame has a hole for accommodating the spiral part of said restricting member, and the hole is defined by a pair of parallel restricting walls sandwiching the spiral part therebetween in abutment with the spiral part at two radially outermost circumferential portions of the spiral part, thus restricting rotation of said restricting member.

* * * * *